US006088859A

United States Patent [19]

Cavazos

[11] Patent Number: 6,088,859

[45] **Date of Patent: *Jul. 18, 2000**

[54] MATTRESS ASSEMBLY WITH RELEASABLE BORDER STRIP

[76] Inventor: Frank G. Cavazos, 14040 Shoshoni Dr., Lockport, Ill. 60441

[ * ] Notice: This patent issued on a continued prosecution application filed under 37 CFR 1.53(d), and is subject to the twenty year patent term provisions of 35 U.S.C. 154(a)(2).

[21] Appl. No.: 09/001,915

[22] Filed: Dec. 31, 1997

[51] Int. Cl.[7] ..... A47C 27/045; A47C 27/04

[52] U.S. Cl. ..... 5/739; 5/737; 5/738

[58] Field of Search ..... 5/499, 737, 738, 5/739, 717, 716, 721, 722, 490, 636

[56] References Cited

U.S. PATENT DOCUMENTS

| | | | |
|---|---|---|---|
| 1,892,913 | 1/1933 | Timm | 5/738 |
| 2,499,698 | 3/1950 | Thomas | 5/499 |
| 2,982,976 | 5/1961 | Ferolito | 5/499 |
| 3,436,771 | 4/1969 | Fisher | 5/499 |
| 3,493,980 | 2/1970 | Haller | 5/699 |
| 3,601,826 | 8/1971 | Smith | 5/499 |
| 4,301,561 | 11/1981 | McLeod | 5/499 X |
| 4,539,057 | 9/1985 | Ahlm | 5/737 X |
| 5,193,238 | 3/1993 | Clute | 5/490 |
| 5,644,811 | 7/1997 | Cavazos | 5/738 |

*Primary Examiner*—Terry Lee Melius
*Assistant Examiner*—Fredrick Conley
*Attorney, Agent, or Firm*—Ernest Kettelson

[57] ABSTRACT

A mattress assembly comprising an innerspring, a top mattress cover over the upper surface of the innerspring, a bottom mattress cover over the lower surface of the innerspring, layers of insulating and cushioning material sandwiched between the mattress covers and innerspring, and a peripherally extending border strip around the entire periphery of the mattress assembly between the peripheral edges of the top and bottom mattress covers which is releasably secured in place, whereby the border strip can be readily unfastened and removed for access to inner portions of the mattress assembly for inspection and repair. When in place, the releasable border strip of this invention appears to be permanently connected to the peripheral edges of the top and bottom mattress covers and an extension thereof.

19 Claims, 5 Drawing Sheets

MATTRESS ASSEMBLY WITH RELEASABLE BORDER STRIP

FIELD OF THE INVENTION

This invention relates to the field of mattresses having an innercushioning member, top and bottom mattress covers and a surrounding border strip extending around the periphery of the mattress between the top mattress cover and the bottom mattress cover. In the present invention, the peripheral border strip extending around the periphery of the mattress is secured to the fabric flanges of the top and bottom mattress covers by tiny releasable hook and loop fastening members.

BACKGROUND OF THE INVENTION

Relevant prior art of which the inventor is aware is set forth in the following patents discovered during his searches for prior art.

U.S. Pat. No. 5,214,809 discloses an articulated mattress for an adjustable bed which has hinge portions between mattress sections for limited pivotal movement of one section relative to another.

U.S. Pat. No. 5,040,255 discloses a cushion or mattress structure comprising a box structure with side, top and bottom walls of foam material, and cavity within the box to receive encased springs.

U.S. Pat. No. 4,956,884 discloses a modular box spring mattress comprising a plurality of plate sub units in which coil springs are received and held by flexible retaining arms. The sub units have cooperative coupling structures to hold adjacent sub units together.

U.S. Pat. No. 4,868,941 discloses an assembled mattress having an upper sheet with integrally formed sleeves or bellows extending downward and a lower sheet with integrally formed sleeves or bellows extending upward, with individual coil springs seated in each of the sleeves or bellows.

U.S. Pat. No. 2,547,840 discloses a sectional mattress comprising three separate sections positioned end to end, with one end of a coil spring connected at each end of the middle section and on both sides thereof, having the other end of each coil spring connected to the adjacent mattress section at each opposite end of the middle section.

U.S. Pat. No. 2,446,775 discloses an innerspring mattress construction made up of sections which are glued together along facing end walls to make up a completed mattress.

U.S. Pat. No. 2,249,266 discloses a combined chair and bed having a mattress like coil spring cushion supported on a hinged frame which folds down into a bed and angularly to form a chair in one position and a recliner in another.

U.S. Pat. No. 2,216,991 discloses three mattress units which are connected end to end to make a complete mattress. The units are connected by a transverse cylindrical bar insert on one unit which is received in a sleeve have a split cylindrical wall around its through passageway on the adjacent unit.

U.S. Pat. No. 1,915,674 discloses a coil spring assembly for making cushions, comprising four or more coils in a row connected by an elongated endless loop of twisted wire which includes one elongated strand connected to one side of each coil in the row and a second parallel strand connected to the opposite side of each coil in the row, such rows of coils in turn being connected to adjacent rows of coils by C-wires or fasteners known as hog rings.

U.S. Pat. No. 1,459,540 discloses a sectional mattress comprising three separate sections that are laid end to end to make up a complete mattress and can be interchanged in their relationship to each other. The innersprings within each section are encased in bags.

The inventor's own U.S. Pat. No. 5,435,026 discloses a do-it-yourself type of mattress which can be put together by the customer after purchasing the necessary component parts.

The inventor's own U.S. Pat. No. 5,471,688 discloses a modular innerspring assembly for a mattress and a modular box spring assembly on which the mattress is placed.

The inventor's own U.S. Pat. No. 5,485,639 discloses an S-shaped metal connecting clip having a spring characteristic to more easily connect the border wire around the top and bottom of an innerspring assembly to the top and bottom coils of adjacent coil springs.

The inventor's own U.S. Pat. No. 5,644,811 discloses a mattress having access to materials sandwiched between the mattress covers and the innerspring or other innercushioning member.

RELATED APPLICATIONS

The inventor herein is also the inventor in co-pending patent application Ser. No. 08/835,184 filed Apr. 7, 1997 for a Modular Mattress and Innerspring.

SUMMARY OF THE INVENTION

The present invention constitutes an improvement over the prior art in that the border strip around the periphery of the mattress assembly need not be sewn or otherwise permanently secured to one or both of the top and bottom mattress covers.

In one embodiment, a peripheral retaining band has a width corresponding to the peripheral side wall dimension of the mattress or innercushioning member. The retaining band has an outwardly facing surface covered by the same material as the outwardly facing surfaces of the top and bottom mattress covers. On the inwardly facing surface, the retaining band includes tiny hook or loop fasteners of the Velcro type to releasably interconnect with corresponding tiny hook or loop fasteners on the fabric flanges of the top and bottom mattress covers.

The retaining band can also be a continuous length of material, preferably having some elasticity, and slipped over the innercushioning member as well as over the fabric flanges of the top and bottom mattress covers in place on the innercushioning member. The mattress may otherwise be of the traditional mattress construction, having an innercushioning member such as an innerspring assembly, cushioning material over the upper and lower surfaces of the innerspring assembly, a mattress cover over such cushioning materials on both surfaces, with the fabric flange of the top mattress cover extending downwardly along and around the peripheral side wall of the mattress assembly and the fabric flange of the bottom mattress cover extending upwardly therealong and therearound. The difference between the present invention and the prior art is that the fabric flanges of the top and bottom mattress covers have tiny fastening hooks or loops to releasably interconnect with corresponding tiny hooks or loops on the inner surface of the border strip extending entirely around the peripheral side wall of the mattress assembly between the mattress covers.

In another embodiment of the invention, wherein the top and bottom mattress covers each have a fabric flange extending from and around its peripheral edge, a strip of tiny hook or loop fastening elements extend around the peripheral free edge of each fabric flange. An innercushiong member such as an innerspring is sandwiched between the mattress covers. The innercushioning member has a strip of material secured around its outer peripheral side wall from which an upwardly extending flap having corresponding hook or loop fastening elements on its inwardly facing surface extends to releasably fasten to the strip of fastening elements on the flange of the top mattress cover, and a downwardly extending flap having corresponding hook or loop fastening elements on its inwardly facing surface extends to releasably fasten to the strip of fastening elements on the flange of the bottom mattress cover.

The outwardly facing surfaces of the upwardly and downwardly extending flaps of the strip of material extending around the outer peripheral side wall of the innercushioning member has a finishing layer or sheet of fabric corresponding to that of the outwardly facing surfaces of the top and bottom mattress covers.

DESCRIPTION OF PREFERRED EMBODIMENTS

Figure 1:
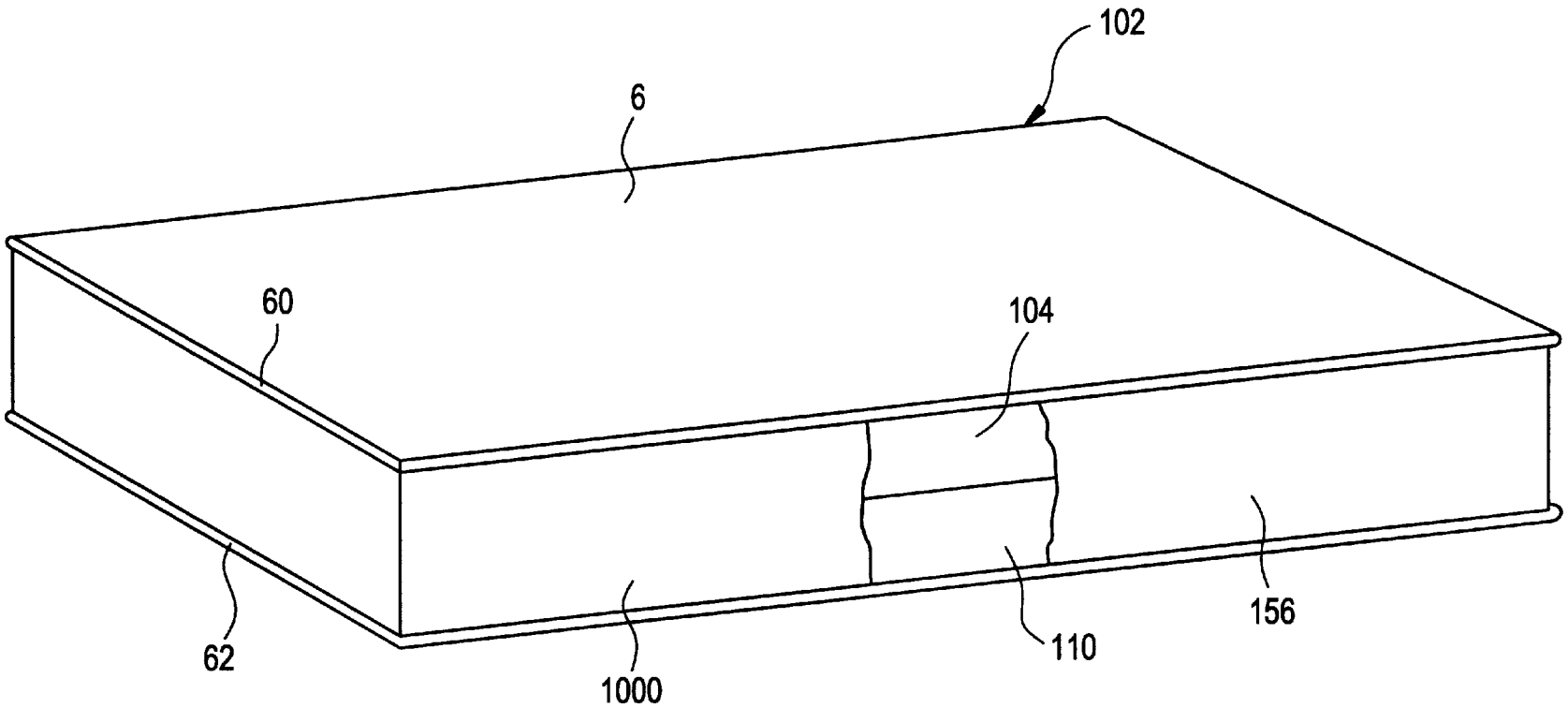
FIG. 1 is a perspective view of one embodiment of a mattress assembly in accordance with this invention, with the sheet of finishing fabric material matching that of the outwardly facing surfaces of the mattress covers, which covers upwardly and downwardly projecting flaps secured to peripheral flanges of the top and bottom mattress covers partially broken away to show the flaps themselves secured to the mattress cover flanges which are covered by the flaps.
Figure 2:
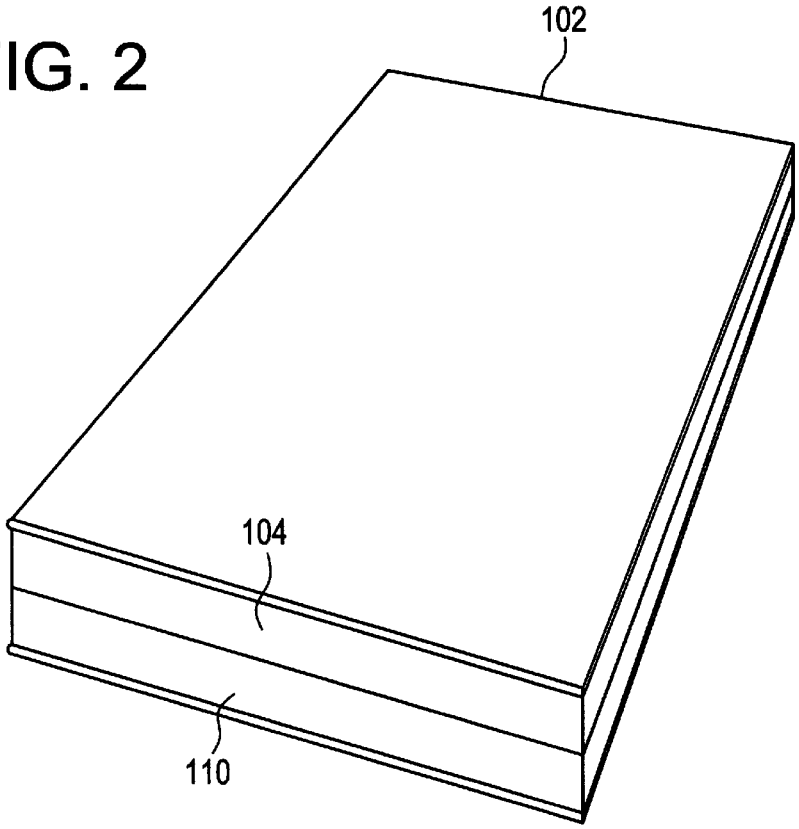
FIG. 2 is a perspective view of the mattress assembly embodiment shown in FIG. 1, but wherein the outwardly facing surfaces of the upwardly and downwardly projecting flaps are themselves made of a finishing fabric material that matches that of the outwardly facing surfaces of the top and bottom mattress covers.
Figure 3:
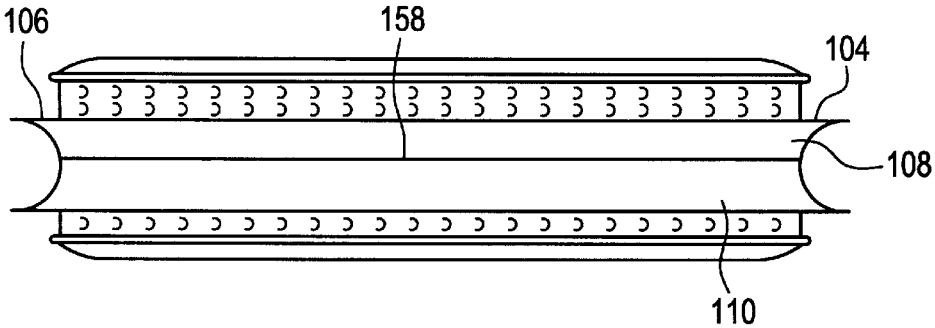
FIG. 3 is an end elevation view of the mattress assembly as shown in FIG. 2, shown with the upwardly and downwardly projecting flaps pulled away from the releasable fastening elements of the fabric flanges of the top and bottom mattress covers.
Figure 4:
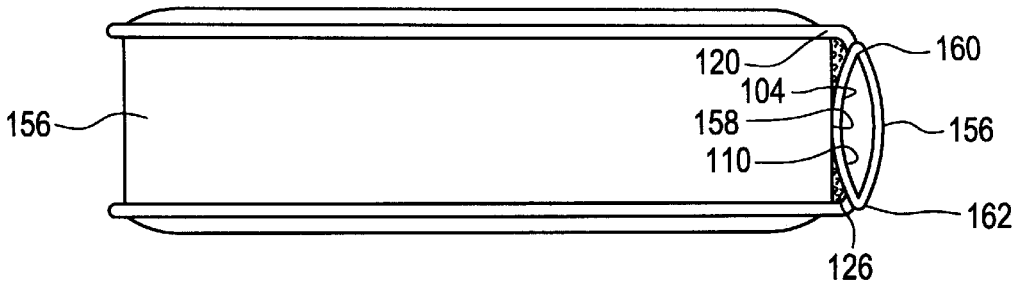
FIG. 4 is an end elevation view of the mattress assembly shown in FIG. 1, with the upwardly and downwardly projecting flaps along the right hand side in this view partially pulled away from the releasable fastening elements of the fabric flanges of the mattress covers and the sheet of matching finishing fabric material shown connected only along the upper edge of the upwardly projecting flap and along the lower edge of the downwardly projecting flap, to be drawn taut against the flaps when they are pressed against and secured to the fabric flanges of the mattress covers.
Figure 5:
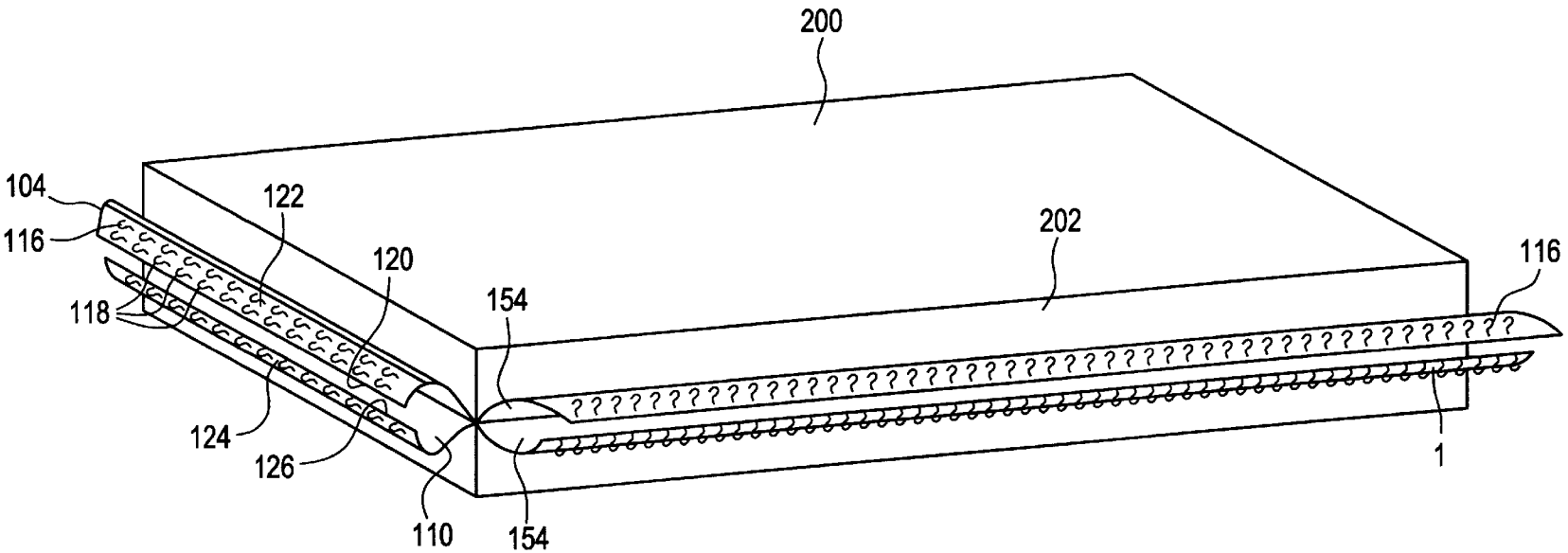
FIG. 5 is a perspective view of a fabric enclosure for the innerspring or other innercushioning member therein, to which the upwardly and downwardly peripheral flaps are secured along the midline of the enclosure's peripheral side wall.
Figure 6:
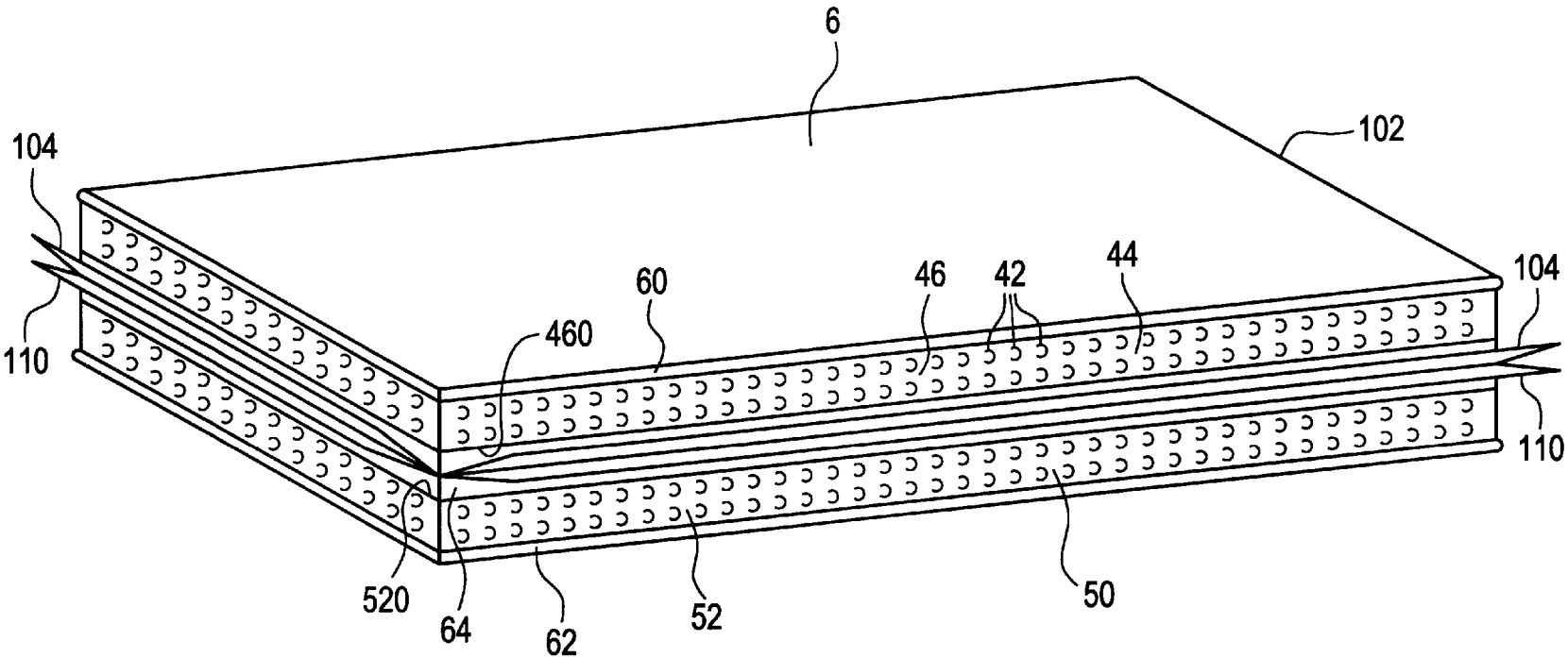
FIG. 6 is a perspective view of the mattress assembly as shown in FIGS. 2 and 3 with the upwardly and downwardly projecting flaps held outwardly and close together to show the peripheral space between the free edges of the fabric flanges of the top and bottom mattress covers which extends around the mattress assembly for the flaps to extend through before folding upwardly and downwardly to face and releasably connect to the fabric flanges of the mattress covers.
Figure 7:
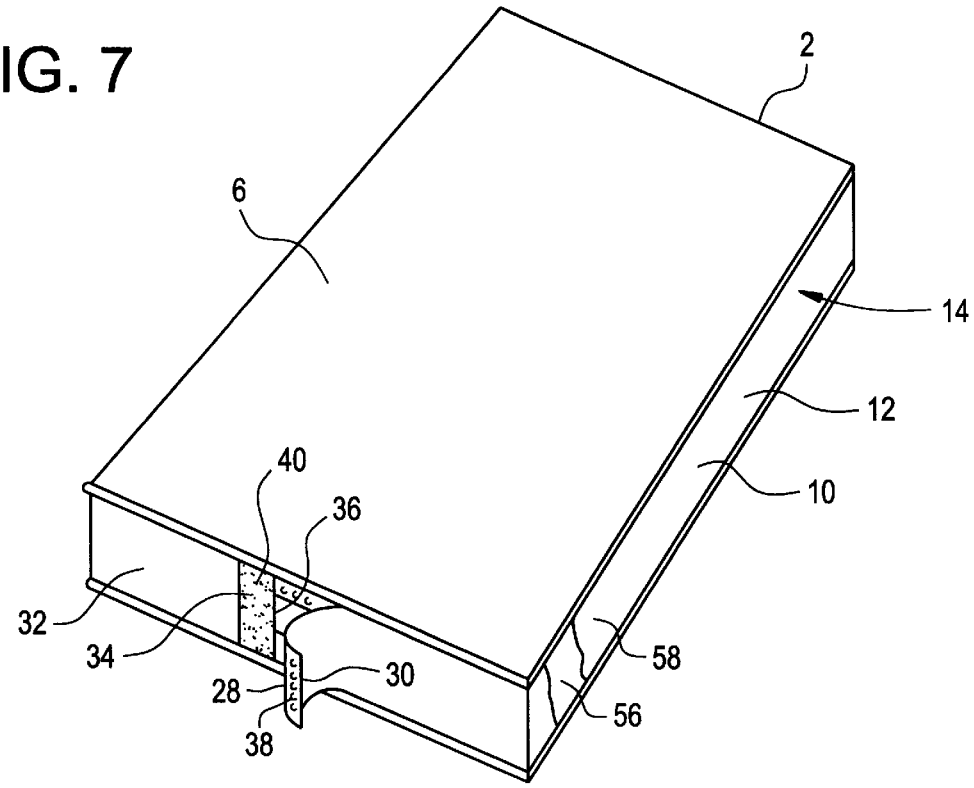
FIG. 7 is a perspective view of another embodiment of the mattress assembly in accordance with this invention, wherein the border strip is a single elongated band which extends around the entire periphery of the mattress assembly between the top and bottom mattress covers, having releasable securing elements on its inwardly facing surface which releasably connect with cooperative releasable securing elements on the outwardly facing surface of the fabric flanges of the mattress covers, one end partially pulled away to show the releasable fastening elements that releasably connect the ends together.
Figure 8:
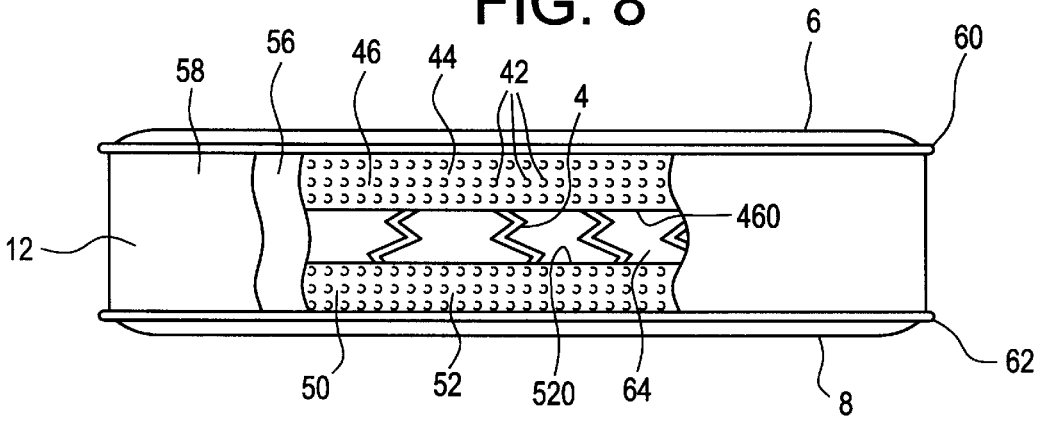
FIG. 8 is an end elevation view of the mattress assembly as shown in FIG. 7, with the border strip partially broken away to illustrate the fabric flanges of the mattress covers and the innerspring.
Figure 9:
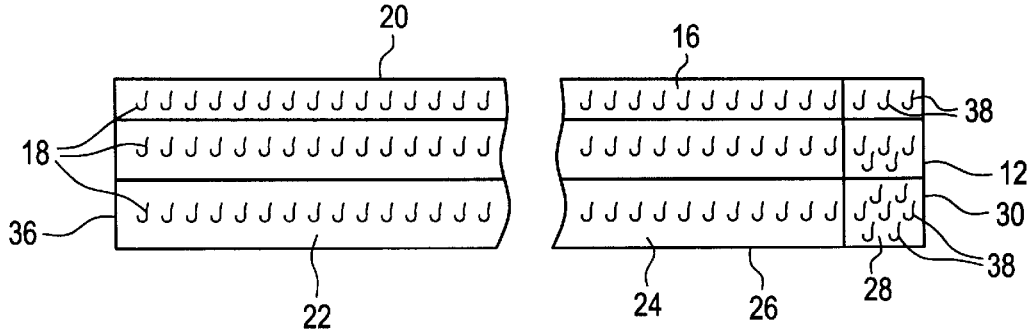
FIG. 9 is an elevation view of the inwardly facing surface of the elongated border strip to illustrate the releasable securing elements thereon, an intermediate section of the border strip being cut away.

A mattress assembly 2 in accordance with the present invention comprises an innercushioning assembly such as an innerspring 4, a top mattress cover 6, a bottom mattress cover 8, and a peripheral border strip 10 in the form of an elongated band 12 that extends around the entire periphery 14 of the mattress assembly 2. The elongated band 12 has a first peripherally extending strip 16 of tiny releasable hook fastening members 18 along the upper edge 20 of the inwardly facing surface 22 of the elongated band 12, and a second peripherally extending strip 24 of said tiny releasable hook fastening members 18 along the lower edge 26 of such inwardly facing surface 22 of the elongated band 12.

The inner surface 22 of the elongated band 12 has a first releasably connecting panel 28 secured thereto at its first end 30. The outer surface 32 of the band 12 has a second releasably connecting panel 34 secured thereto at the second end 36 of the elongated band 12. The connecting panel 28 includes a plurality of tiny hook shaped projections 38 extending therefrom, which interengage with a corresponding plurality of tiny loop members 40 projecting outward from the second connecting panel 34, when the elongated peripheral band 12 is placed around the periphery of the mattress assembly 2 and the two connecting panels are brought together. The interengaged hook and loop members of the connecting panels 28 and 34 releasably join the ends 30 and 36 of the elongated band 12.

The first peripherally extending strip 16 of releasable hook fastening members 18 releasably interconnect with corresponding tiny releasable loop fastening members 42 secured to the outwardly facing surface 44 of the fabric flange 46 which is secured to the innerspring 4 and extends around the periphery of the top mattress cover 6 hanging downwardly therefrom.

The second peripherally extending strip 24 of such releasable hook fastening members 18 releasably interconnect with corresponding tiny releasable loop fastening members 42 secured to the outwardly facing surface 50 of the fabric flange 52 which is secured to the innerspring 4 and extends around the periphery of the bottom mattress cover 8 projecting upwardly therefrom.

The elongated band 12 can be made of an elastic stretchable material, such as interwoven fabric encased lengths of stretchable material. The retaining band 12 can also be made of flexible non-stretchable material. The outwardly facing surface 56 of the elongated band 12 which makes up the border strip in this modification comprises a fabric layer or sheet 58 of finishing fabric material that matches the outer fabric material of the top and bottom mattress covers 6 and 8.

When the peripheral border strip 10 of this modification is in place as described above, its upper edge 20 is in continuous contact with the corresponding peripheral edge 60 of the top mattress cover 6 around the entire periphery of the mattress assembly 2, and the lower edge 26 of the border strip 10 is also in continuous contact with the corresponding peripheral edge 62 of the bottom mattress cover 8 around the entire periphery of the mattress assembly 2. From all appearances, the border strip 10 of this embodiment of the invention appears to be integrally joined to the respective peripheral edges of the top and bottom mattress covers. However, when it is necessary or desired to gain access to the inner portions of the mattress assembly 2, the releasable connecting members of the border strip 10 of this embodiment can be manually separated to release the ends 30 and 36 and to then pull the portions of the peripheral band 12 which extend inwardly from the respective ends away from their releasable connections with the fabric flanges of the top and bottom mattress covers. This enables quick and easy access to the inner portions of the mattress assembly 2 for inspection and repair or replacement of any parts thereof needing replacement or repair. After such repairs or replacements have been made, the border strip 10 of this embodiment can be quickly and easily re-connected to the interconnecting members throughout the periphery of the fabric flanges of the top and bottom mattress covers, and the interconnecting members at the ends 30 and 36 of the peripheral band 12 can then be again connected to complete the re-connection of the border strip 10 to the mattress assembly 12.

In a second embodiment of the invention, the fabric flanges 46 and 52 of the top and bottom mattress covers 6 and 8 respectively remain the same as described above. However, instead of an elongated peripheral band 12, the border strip 1000 of this second embodiment is described as follows. It consists of an upwardly projecting peripheral flap 104 that extends around the entire periphery of the innerspring 4 or other innercushioning member midway between its upper surface 106 and its lower surface 108, and a downwardly projecting flap 110 that also extends around the entire periphery of the innerspring 4 at a point midway between the upper and lower surfaces.

The upwardly projecting flap 104 has a first peripherally extending strip 116 of tiny releasable hook fastening members 118 along the upper edge 120 of the inwardly facing surface 122 of upwardly projecting peripheral flap 104. A second peripherally extending strip 124 of said tiny releasable hook fastening members 118 is provided along the lower edge 126 of the inwardly facing surface 122 of the downwardly projecting peripheral flap 110.

The first peripherally extending strip 116 of releasable hook fastening members 118 around the periphery of the inwardly facing surface 122 of the upwardly projecting flap 104 releasably interconnect with the corresponding tiny releasable loop fastening members 42 secured to the outwardly facing surface 44 of the fabric flange 46 which extends around the periphery of the top mattress cover 6 hanging downwardly therefrom. The second peripherally extending strip 124 of releasable hook fastening members 118 around the periphery of the inwardly facing surface 122 of the downwardly projecting flap 110 releasably interconnect with the corresponding tiny releasable loop fastening members 42 secured to the outwardly facing surface 50 of the fabric flange 52 which extends around the periphery of the bottom mattress cover 8 projecting upwardly therefrom.

The outwardly facing surface 154 of the upwardly and downwardly projecting flaps 104 and 110 when releasably secured to the respective fabric flanges of the top and bottom mattress covers as described, around the entire periphery of the mattress assembly 102 of this embodiment, forms the border strip 1000 of mattress assembly 102. The upwardly projecting flap 104 has a lateral or width dimension substantially equal to one half the dimension or distance between the upper surface 106 and lower surface 108 of the innerspring 4. The downwardly projecting flap 110 also has a lateral or width dimension substantially equal to one half the dimension or distance between the upper surface 106 and lower surface 108 of innerspring 4. Thus, when the upwardly projecting flap 104 is releasably secured to the fabric flange of the top mattress cover 6 and the downwardly projecting flap 110 is releasably secured to the fabric flange of the bottom mattress cover 8, the entire peripheral side wall of the innerspring 4 is covered by such flaps from their continuous peripheral contact against the peripheral edge 60 of the top mattress cover 4 to their continuous peripheral contact with the peripheral edge 62 of the bottom mattress cover 8.

The outwardly facing surface 154 of the upwardly and downwardly projecting flaps 104 and 110 comprises a fabric layer or sheet 156 of finishing fabric material that matches the outer fabric material of the top and bottom mattress covers. From all appearances, the border strip 1000 of this embodiment of the invention appears to be integrally joined to the respective peripheral edges of the top and bottom mattress covers. However, the upwardly and downwardly projecting flaps can be readily separated from the respective fabric flanges of the top and bottom mattress covers by pulling the respective hook and loop releasable fastening members apart, to gain access to the inner portions of the mattress assembly 102 for inspection and repair or replacement if and when that should become necessary.

The sheet 156 of finishing fabric material which matches that of the outwardly facing surfaces of the top and bottom mattress covers may have a width that extends from the peripheral edge of the top mattress cover to the peripheral edge of the bottom mattress cover, so when placed over the outwardly facing surface of the flaps the peripheral midline 158 along which the flaps are secured to the peripheral side wall of the innerspring 4 or innercushioning member is covered over. The upper edge 160 of sheet 156 may be sewn to and along the upper edge 120 of upwardly projecting flap 104 and the lower edge 162 of sheet 156 may be sewn to and along the lower edge 126 of downwardly projecting flap 110. When the flaps 104 and 110 are pressed against and secured to the respective flanges of the top and bottom mattress covers with the upper edge 122 of flap 104 adjacent the peripheral edge of the top mattress cover and the lower edge 126 of the flap 110 adjacent the peripheral edge of the bottom mattress cover, the sheet 156 of finishing fabric material is drawn taut against the outwardly facing surfaces of the flaps 104 and 110.

The upwardly and downwardly projecting flaps 104 and 110 may be secured to the peripheral side wall of the innerspring 4 or other innercushioning member in a number of different ways. As shown and described herein, a fabric enclosure or bag 200 is provided to receive the innerspring 4 or other innercushioning member therein. The peripherally extending fabric flaps 104 and 110 are sewn or otherwise secured to the peripheral side wall 202 of the fabric enclosure 200 and extend around the entire periphery thereof. The enclosure 200 and its flaps 104 and 110 may be of a less expensive type of fabric than that of the outwardly facing surfaces of the mattress covers 6 and 8, in which case fabric matching that of the outwardly facing surfaces of the mattress covers is sewn or otherwise secured to the outwardly facing surfaces of the flaps 104 and 110.

Before the mattress covers 6 and 8 are placed over the innerspring 4 or other innercushioning member, layers of insulating and cushioning material are put in place over both of its oppositely facing surfaces. The top and bottom mattress covers are then put over the layers of insulating and cushioning material to sandwich them between the mattress covers and the innerspring. The fabric flanges 46 and 52 of the mattress covers 6 and 8 are secured to the peripheral side wall of the innerspring 4. When so secured, the free edge 460 of the top mattress cover flange 46 and the free edge 520 of the bottom mattress cover flange 52 are spaced apart leaving a peripherally extending space 64 therebetween around the periphery of the mattress assembly.

In the second embodiment described hereinabove, the peripherally extending fabric flaps 104 and 110 around the peripheral side wall 202 of the innerspring enclosure 200 project through the peripherally extending space 64 to then fold upwardly in the case of fabric flap 104 to be releasably secured to the top mattress cover flange 46, and to then fold downwardly in the case of fabric flap 110 to be releasably secured to the bottom mattress cover fabric flange 52.

I claim:

1. A mattress assembly comprising an innercushioning member having a substantially planar upper surface, an oppositely facing substantially planar lower surface extending substantially parallel to said upper surface, and a peripheral side wall extending in a direction substantially normal to said upper and lower surfaces, a top mattress cover having a peripheral edge on said upper surface of said innercushioning member, a bottom mattress cover having a peripheral edge on said lower surface of said innercushioning member, a peripheral space extending around said mattress assembly between said peripheral edge of said top mattress cover and said peripheral edge of said bottom mattress cover, a releasable peripheral border strip for releasable connection to said mattress assembly and to cover said peripheral space, said releasable peripheral border strip having an upper edge and a lower edge and including mattress stabilizing means, such mattress stabilizing means including an upper overlap portion of said peripheral border strip extending inwardly thereof from said upper edge of said border strip to an inner edge of said upper overlap portion spaced apart from said upper edge of said border strip and a lower overlap portion of said peripheral border strip extending inwardly thereof from said lower edge of said border strip to an inner edge of said lower overlap portion spaced apart from said lower edge of said border strip for releasable overlap connection along said peripheral edges of respective ones of said top and bottom mattress covers, said overlap portions each having an inwardly facing surface facing inwardly when in place on said mattress assembly, and releasable connection means on said inwardly facing surfaces throughout said overlap portions thereby having an extended lateral dimension as well as an extended longitudinal dimension to both stabilize and releasably connect said overlap portions of said releasable peripheral border strip to said mattress assembly along said peripheral edges of respective ones of said top and bottom mattress covers.

2. A mattress assembly as set forth in claim 1, wherein said top mattress cover includes a peripheral flange extending from its said peripheral edge and said bottom mattress cover includes a peripheral flange extending from its said peripheral edge, said inwardly facing surface of said upper overlap portion of said releasable border strip facing and being releasably connected to said peripheral flange of said top mattress cover and said inwardly facing surface of said lower overlap portion of said releasable border strip being releasably connected to said peripheral flange of said bottom mattress cover.

3. A mattress assembly as set forth in claim 2, wherein said peripheral flanges each have an inwardly facing surface in facing relationship with said innercushioning member and an outwardly facing surface, said releasable connection means including a first releasable connecting member on each of said outwardly facing surfaces of said peripheral flanges.

4. A mattress assembly as set forth in claim 3, wherein said releasable peripheral border strip includes an elongated strip of fabric material having an inwardly facing surface and an outwardly facing surface, said releasable connection means includes a pair of second releasable connecting members on said inwardly facing surface of said elongated strip of fabric material along said upper and lower edges of said peripheral border strip and said elongated strip of fabric material thereof positioned for registration with respective ones of said first releasable connecting members on said outwardly facing surfaces of each of said peripheral flanges, said second releasable connecting members being releasably connectable to said first releasable connecting members.

5. A mattress assembly as set forth in claim 4, wherein said first releasable connecting member includes a first strip of connecting member supporting material secured to said outwardly facing surface of each of said peripheral flanges, said peripheral flange of said top mattress cover being in facing relationship with said upper edge of said inwardly facing surface of said elongated strip of fabric material and said peripheral flange of said bottom mattress cover being in facing relationship with said lower edge of said inwardly facing surface of said elongated strip of fabric material, said first strip of connecting member supporting material having a plurality of first cooperative releasable connecting members thereon.

6. A mattress assembly as set forth in claim 5, wherein said second releasable connecting member includes a second strip of connecting member supporting material secured to said inwardly facing surface of said upper and lower edges of said elongated strip of fabric material, said second strip of connecting member supporting material having a plurality of second cooperative releasable connecting members thereon.

7. A mattress assembly as set forth in claim 6, wherein said plurality of first cooperative releasable connecting members includes a plurality of tiny loop members.

8. A mattress assembly as set forth in claim 7, wherein said plurality of second cooperative releasable connecting members includes a plurality of tiny hook members.

9. A mattress assembly as set forth in claim 1, wherein said peripheral space extending around said mattress assembly between said peripheral edge of said top mattress cover and said peripheral edge of said bottom mattress cover opens to said peripheral side wall of said innercushioning member, said top mattress cover includes a peripheral flange extending from its said peripheral edge, said bottom mattress cover includes a peripheral flange extending from its said peripheral edge, said peripheral flanges of said top and bottom mattress covers extending in respective directions toward each other along said peripheral side wall of said innercushioning member and terminating short of each other to leave an open portion of said peripheral space opening to said peripheral side wall of said innercushioning member, said releasable border strip having a first peripheral flap, said releasable border strip being removably secured to said innercushioning member, said first peripheral flap extending from said peripheral side wall of said innercushioning member through said open portion of said peripheral space and projecting upwardly for facing relationship with said outwardly facing surface of said peripheral flange of said top mattress cover, said first peripheral flap having an upper edge adjacent said peripheral edge of said top mattress cover for releasable connection adjacent thereto, said border strip includes a second peripheral flap extending from said peripheral side wall of said innercushioning member through said open portion of said peripheral space and projecting downwardly for facing relationship with said outwardly facing surface of said peripheral flange of said bottom mattress cover, said second peripheral flap having a lower edge adjacent said peripheral edge of said bottom mattress cover for releasable connection adjacent thereto.

10. A mattress assembly as set forth in claim 9, wherein said releasable connection means to releasably connect said peripheral border strip to said mattress assembly includes a first releasable connecting member on each of said outwardly facing surfaces of said peripheral flanges, said peripheral flange of said top mattress cover being in facing relationship with said upper edge of said inwardly facing surface of said first peripheral flap and said peripheral flange of said bottom mattress cover being in facing relationship with said lower edge of said inwardly facing surface of said second peripheral flap, said first releasable connecting member supporting material having a plurality of first cooperative releasable connecting members thereon.

11. A mattress assembly as set forth in claim 10, wherein said first peripheral flap and said upper edge thereof has an inwardly facing surface facing inwardly toward said outwardly facing surface of said peripheral flange of said top mattress cover when in place and an opposite outwardly facing surface, said second peripheral flap and said lower edge thereof has an inwardly facing surface facing inwardly toward said outwardly facing surface of said peripheral flange of said bottom mattress cover when in place and an opposite outwardly facing surface, a second releasable connecting member on each of said inwardly facing surfaces of each of said flaps, each of said second releasable connecting members being releasably connectable to respective ones of said first releasable connecting members.

12. A mattress assembly as set forth in claim 11, wherein said first releasable connecting member includes a first strip of connecting member supporting material secured to said outwardly facing surface of each of said peripheral flanges, said first strip of connecting member supporting material having a plurality of first cooperating releasable connecting members thereon.

13. A mattress assembly as set forth in claim 12, wherein said second releasable connecting member includes a second strip of connecting member supporting material secured to said inwardly facing surfaces of each of said flaps, said second strip of connecting member supporting material having a plurality of second cooperative releasable connecting members thereon.

14. A mattress assembly as set forth in claim 13, wherein said plurality of first cooperative releasable connecting members includes a plurality of tiny loop members.

15. A mattress assembly as set forth in claim 14, wherein said plurality of second cooperative releasable connecting members includes a plurality of tiny hook members.

16. A mattress assembly as set forth in claim 11, wherein said top and bottom mattress covers each have outwardly facing surfaces, said outwardly facing surfaces of said top and bottom mattress covers each being covered by a sheet of selected matching fabric material.

17. A mattress assembly as set forth in claim 16, wherein said outwardly facing surfaces of said peripherally extending flaps are covered by a peripherally extending sheet of selected fabric material which matches that of said selected matching fabric material of said outwardly facing surfaces of said top and bottom mattress covers.

18. A mattress assembly as set forth in claim 4, wherein said top and bottom mattress covers each have outwardly facing surfaces, said outwardly facing surfaces of said top and bottom mattress covers each being covered by a sheet of selected matching fabric material.

19. A mattress assembly as set forth in claim 18, wherein said border strip is covered by an elongated sheet of selected fabric material which matches that of said selected matching fabric material of said outwardly facing surfaces of said top and bottom mattress covers.

* * * * *